United States Patent [19]

Formanik

[11] 4,128,463

[45] Dec. 5, 1978

[54] METHOD FOR STRIPPING TUNGSTEN CARBIDE FROM TITANIUM OR TITANIUM ALLOY SUBSTRATES

[75] Inventor: Bert J. Formanik, Willowick, Ohio

[73] Assignee: TRW Inc., Cleveland, Ohio

[21] Appl. No.: 882,636

[22] Filed: Mar. 2, 1978

[51] Int. Cl.[2] ..... C25F 5/00; C25F 3/02

[52] U.S. Cl. ..... 204/146; 204/129.9

[58] Field of Search ..... 204/146, 129.9, 129.95

[56] References Cited

U.S. PATENT DOCUMENTS

| | | | |
|---|---|---|---|
| 2,316,579 | 4/1943 | Hall | 204/146 |
| 3,632,490 | 1/1972 | Covington | 204/141 |
| 3,793,172 | 2/1974 | Cadieux | 204/146 |

*Primary Examiner*—T. M. Tufariello

[57] ABSTRACT

A process for electrochemically stripping tungsten carbide from a titanium or titanium alloy substrate in an electrolytic cell. A tungsten carbide coated titanium or titanium alloy workpiece is immersed in an aqueous solution of chromic acid and made the anode in the electrolytic cell. An inert metallic cathode is provided. Direct current is imposed on the cell to effect anodic stripping of the titanium or titanium alloy substrate.

9 Claims, 1 Drawing Figure

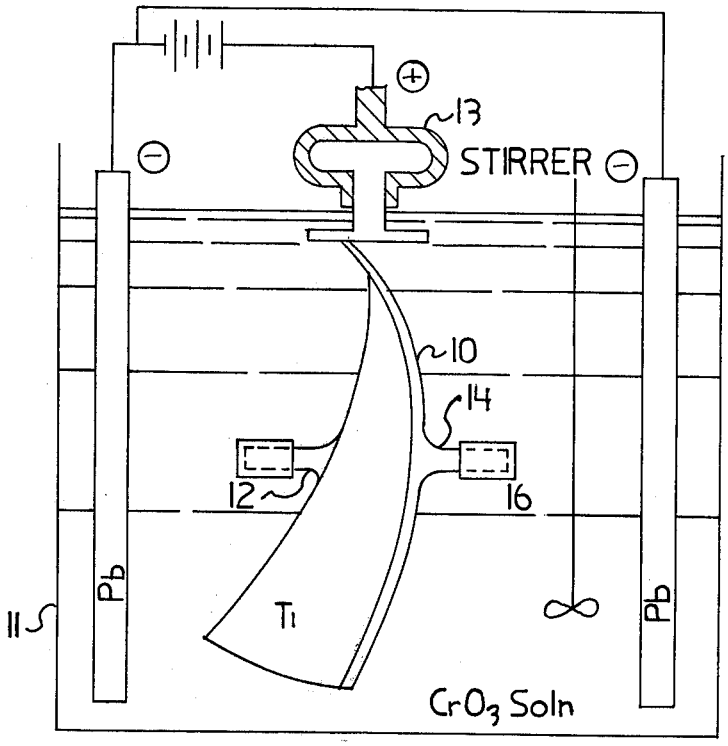
13
STIRRER
10
14
12
16
11
Pb
Ti
Pb
CrO3 Soln

METHOD FOR STRIPPING TUNGSTEN CARBIDE FROM TITANIUM OR TITANIUM ALLOY SUBSTRATES

BACKGROUND OF THE INVENTION AND PRIOR ART

The present invention relates to a process for separating tungsten carbide from a titanium or titanium alloy substrate. Various aircraft components and engine components are today manufactured from titanium or titanium base alloys. Surfaces of such articles subject to wear are frequently coated with a wear resistant material such as tungsten carbide. In the recovery of titanium metal or titanium base alloy for reworking from scrap or salvage parts, or the resurfacing of otherwise sound parts it is necessary to remove the carbide coating prior to reworking the metal. Coatings of various kinds have been applied to titanium substrates for various purposes. These coatings have included plated material such as nickel and chromium, or scale as a result of oxidation of the surface due to high temperature heat treating, or the like.

For removing metal coatings from titanium or titanium alloy bases, it has been found that an electrolytic process can be used. This process utilizes as the electrolyte chromium trioxide ($CrO_3$) dissolved in water. The workpiece is made the anode, and the cell is operated at a current density of between 100 and 250 amperes per square foot. The temperature of the electrolye is in the range of from 155° to 185° F. The results are improved by the inclusion of boric acid ($H_3BO_3$). This is according to the process of Hall U.S. Pat. No. 2,316,579.

Titanium and titanium base alloys may be descaled of oxide coatings in a two step process disclosed by Covington U.S. Pat. No. 3,632,490. Two separate electrolytes are provided in separate tanks. In the first tank, the workpiece is the cathode of the cell, and in the second tank, the workpiece is the anode of the cell. In this case, the electrolyte is a solution of sodium dichromate and hydrofloric acid. The temperature of the electrolyte solutions is about 185° F., and the voltage from 6 to 17 volts of 20 amperes. The current density in the cathodic cycle ranges from 100 to 1000 amperes per square foot, and in the anodic cycle should be between 80 and 1000 amperes per square foot. The time of exposure is approximately 5 minutes at 200 amperes per square foot.

In another process utilizing a titanium base metal, an electrolytic stripping process is taught by Cadieux U.S. Pat. No. 3,793,172. This process relates to the stripping of copper-nickel-chromium deposits from titanium. The stripping bath compositions consist of aqueous solutions of fluoboric acid ($HBF_4$), phosphoric acid ($H_3PO_4$) and water. In use the current density is about 16 amperes per square inch with an operating voltage of 7.5 volts DC. The stripping time was generally less than about 3 minutes.

In general, the prior art processes have depended upon deplating or mechanically loosening scale by electrolytically generated hydrogen gas using the workpiece as one of the electrodes in a predetermined electrolyte composition. In deplating, the materials which are deplated are elemental metals. In the present invention, the material being removed or stripped from the titanium or titanium alloy is tungsten carbide.

SUMMARY OF THE INVENTION

The present invention provides a method for removal of tungsten carbide from titanium or titanium alloy workpieces. According to the process, the workpiece is made the anode in an electrolytic cell utilizing as an electrolyte, an aqueous solution of chromic acid, preferably containing sulfate ion. The normal operating voltage is from 6 to 9 volts at a current density of from about 4 to about 9 amperes per square foot for a period of at least about three-quarters of an hour and at a temperature of about 100° F. By this process, the substrate is not deleteriously affected. The tungsten carbide coating is completely removed without effect on the base metal. The present method is faster than prior art methods, requires no surveillance or additional handling until coating removal is attained. Stripping is accomplished in a wide range of solution concentrations, and parts may be fully or partially immersed without any surface effects. A surface discoloration may form which is easily removed by immersing the part in nitric-hydrofluoric acid solution for a few seconds. Another advantage of the present process is that the stripping process actually cleans all immersed surfaces and removes any other coatings which may be present.

BRIEF DESCRIPTION OF THE DRAWING

The annexed drawing is a diagrammatic representation of an electrolytic cell useful in accordance with the present invention for stripping tungsten carbide from titanium or titanium alloy workpieces. The workpiece illustrated is a gas turbine blade having tungsten carbide as a hard surfacing material applied to titanium midspan surfaces for wear resistance. There is need to remove this coating when it is faulty or worn and the workpiece is to be reconditioned.

DETAILED DESCRIPTION OF THE INVENTION AND SPECIFIC EXAMPLES

The tungsten carbide coatings which are applied by various means, for example plasma flame spray application techniques, have a thickness of from about 0.010 to 0.015 inch to provide a hard surface for long life wear characteristics. If the coating is faulty, e.g. incomplete, or is worn so as to require replacement, the previous coating must be stripped from the surface. Moreover, the stripping must be done without any attack on the titanium or titanium alloy substrate. Although pure titanium metal may be used as the material from which jet engine airfoil or blade elements may be fabricated, the usual material employed is an alloy. A typical example of a titanium alloy useful in the fabrication of aircraft parts is known as Ti-6Al-4V (AMS 4928) titanium alloy.

When shaped in the manner shown in the annexed drawing, the midspan surfaces 12 and 14 are coated at their distal extremities as shown at 16 with tungsten carbide. This coating provides a hard surface of excellent wear characteristics, and is the surface which must be stripped of the tungsten carbide prior to recovering or reclamation of the titanium or titanium alloy substrate for reworking.

As shown in drawing, the titanium or titanium alloy workpiece 10 is supported in an electrolytic cell 11, and connected by a suitable supporting fixture 13 into a direct current circuit as the anode. The cathode may be any suitable conductor which is not attached by the electrolyte, e.g. lead, carbon, titanium or other conductor inert to the electrolyte.

The electrolyte is an aqueous solution of chromic oxide ($CrO_3$) or any other material capable of producing chromate ions in solution. Thus, instead of chromic acid, soluble chromates and bichromates may be substituted therefor and are to be considered the equivalent of chromic acid on a stoichiometric basis. The term "chromic acid equivalent" as used herein is intended to include chromic acid itself ($CrO_3$) and stoichiometrically equivalent weights of soluble chromates and bichromates. Commercial $CrO_3$ contains a small amount of sulphate which is believed beneficial although not essential to the present process.

The composition of the electrolyte may vary quite widely. In general, the electrolyte is an aqueous solution, e.g. a tap water solution of chromic acid or an equivalent chromate ion producing material, e.g. sodium bichromate in a stoichiometrically equivalent amount, in an amount ranging from about 4% to about 40% by weight of chromate ($CrO_3$). The water may be distilled or tap water. The electrolyte may optionally contain from about 0.03% to about 1.0% by weight of total sulfate ion added as sulfuric acid. It should be noted that commercial $CrO_3$ may contain a small amount of $SO_4$—.

The following Table I gives typical examples of aqueous electrolyte solutions useful in accordance with the present invention. The numerical values are parts by weight.

| | ELECTROLYTE SOLUTIONS | | |
|---|---|---|---|
| Ex. No. | $H_2O$ | $CrO_3$ | $H_2SO_4$ (*Total* $SO_4$—) |
| 1 | 128 | 6 | — |
| 2 | 128 | 17 | 0.045 |
| 3 | 128 | 28 | 1.5 |
| 4 | 128 | 33 | 1.0 |
| 5 | 128 | 40 | 0.3 |
| 6 | 128 | 50 | 1.8 |
| 7 | 128 | 80 | 0.045 |

Best results have been secured with Example 4 above at a temperature of 130° F. to 140° F. for 60 to 80 minutes at a current density of from 4 to 8 amperes per square foot. Lead cathode in a glass vessel was used. Complete stripping of a tungsten carbide coating on midspan portions of a titanium alloy blade such as illustrated in the annexed drawing was obtained.

In use, the concentration of the chromate ion gradually decreases because of reaction with the tungsten carbide. A precipitate is formed which settles to the bottom of the cell and which may be removed from time to time as desired. Under such conditions, the time of exposure will tend to increase with use. Thus at the lower concentrations of $CrO_3$, the time of residence in the electrolytic cell will be longer for the lower concentrations than for the higher concentrations. Also, the presence of sulfate ion apparently aids in catalyzing the removal of the tungsten carbide from the workpiece surface. Still further, it will be found that the thicker the tungsten carbide coating, the longer will be required for complete stripping from the workpiece surface. After stripping of the tungsten carbide is complete, further residence time in the electrolyte bath will cause no damage to the base material. Accordingly there is no upper limit on the time of exposure to stripping conditions.

The temperature of the electrolyte in the electrolytic cell during operation thereof is preferably above about 90° F., up to about 180° F. For most purposes, a suitable temperature is in the range of from 120° to 140° F. Higher temperatures tend to decrease residence time. The voltage which is applied to the cell across the electrodes may vary widely. In general, faster stripping is achieved at the higher voltages, and a direct current of from 6 to 40 volts has been found suitable for most operations.

The current density is relatively low and ranges from about 0.025 to about 0.075 amperes per square inch, or 3.6 to 10.8 amperes per square foot. In a voltage range of 6 to 9 volts, from about 25 to about 50 amperes may be drawn in treating an area of approximately 6 square feet. The time of residence in the electrolytic bath depends upon the thickness of the coating to be removed and the other conditions mentioned above. The time in a fresh electrolyte solution to strip 0.008 inch to 0.010 inch is from 60 to 80 minutes at a voltage of from 6 to 9 volts and current density of from 3.6 to 10 amperes per square foot. Voltage and current may vary during a given stripping operation. Agitation of the bath improves the rate of removal of the tungsten carbide coating. To this end, a stirring device may be provided for the electrolytic bath and vigorous, roiling agitation created. To maintain the temperature of the bath within the desired range, heating coils or electric resistance heaters may be provided. When higher voltages are used, the time of exposure may be reduced. For example at 40 volts, about 30 minutes to be found satisfactory.

To illustrate commercially unacceptably long residence time at or near marginal conditions a 5% electrolyte solution at 95° F. at 40 volts and a current density of about 5 a.p.s.f. without agitation failed to strip tungsten carbide completely from blade midspan portions in three 30 minute cycles. Removal of some WC was, however, evident. Residence time may be improved in this case by adjusting upwardly one or more of those factors, e.g. $CrO_3$ concentration, temperature, or current density, or any combination of those factors.

Accordingly, there has been provided an improved method for electrochemically stripping tungsten carbide from a titanium or titanium alloy substrate in an electrolytic cell. The workpieces when removed from the cell may contain a slight surface discoloration. This is easily removed by immersing the part in a nitric-hydrofluoric acid solution for a few seconds. The resultant workpiece is completely clean and even though surfaces which were not coated with tungsten carbide are cleaned by the action of the electrolytic cell.

What is claimed is:

1. A method for electrochemically stripping tungsten carbide from a titanium or titanium alloy substrate in an electrolytic cell which comprises immersing a titanium workpiece having a tungsten carbide coating thereon as an anode in an aqueous solution of chromic acid together with a metallic cathode inert to said aqueous chromic acid solution, imposing a direct current voltage across the anode and cathode in the range of from about 6 to about 50 volts at a current density of from about 4 to about 40 amperes per square foot for a period of at least about 30 minutes at a temperature of at least about 100° F., the concentration of the chromic acid solution being from 4% to 40% by weight.

2. A method in accordance with claim 1 wherein the aqueous solution also contains a small amount of sulfate ion.

3. A method in accordance with claim 2 wherein the concentration of the sulfate ion is in the range of from about 0.03 to about 1.0% by weight.

4. A method in accordance with claim 1 in which the metallic cathode is lead.

5. A method in accordance with claim 1 wherein the concentration of the chromic acid is from about 5% to about 40% by weight.

6. A method in accordance with claim 1 wherein the aqueous solution of chromic acid is agitated during the stripping operation.

7. A method in accordance with claim 1 wherein the period of exposure to electrolytic bath is from 60 to 80 minutes.

8. A method in accordance with claim 1 wherein the temperature of the bath is from 130° to 140° F.

9. A method in accordance with claim 1 wherein the aqueous solution of chromic acid contains about 20% by weight chromic acid, from about 0.03 to about 0.75% sulfate ion, the voltage is from 6 to 9 volts, the current density is from 4 to 8 amperes per square foot, the period is from 60 to 80 minutes and the temperature is from 130° to 140° F.

* * * * *